US008879951B2

(12) United States Patent
Hashimoto et al.

(10) Patent No.: US 8,879,951 B2
(45) Date of Patent: Nov. 4, 2014

(54) IMAGE FORMING APPARATUS

(71) Applicants: Junichi Hashimoto, Toyohashi (JP); Makoto Souda, Nagoya (JP)

(72) Inventors: Junichi Hashimoto, Toyohashi (JP); Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 70 days.

(21) Appl. No.: 13/754,354

(22) Filed: Jan. 30, 2013

(65) Prior Publication Data

US 2013/0195505 A1 Aug. 1, 2013

(30) Foreign Application Priority Data

Jan. 31, 2012 (JP) ..... 2012-018908

(51) Int. Cl.
*G03G 15/00* (2006.01)
*G03G 21/16* (2006.01)
*G03G 21/18* (2006.01)

(52) U.S. Cl.
CPC ..... *G03G 21/1633* (2013.01); *G03G 21/1828* (2013.01); *G03G 21/1671* (2013.01)
USPC ..... 399/110; 399/111

(58) Field of Classification Search
USPC ..... 399/110, 111
See application file for complete search history.

(56) References Cited

U.S. PATENT DOCUMENTS

| | | | | |
|---|---|---|---|---|
| 7,085,504 | B2 * | 8/2006 | Matsuyama et al. | 399/21 |
| 7,184,682 | B2 | 2/2007 | Chadani et al. | |
| 2006/0008289 | A1 * | 1/2006 | Sato et al. | 399/106 |
| 2006/0024080 | A1 | 2/2006 | Chadani et al. | |
| 2007/0071495 | A1 * | 3/2007 | Hashimoto et al. | 399/111 |
| 2007/0141889 | A1 | 6/2007 | Chadani et al. | |
| 2008/0240773 | A1 * | 10/2008 | Sato et al. | 399/106 |
| 2009/0003876 | A1 * | 1/2009 | Maeshima et al. | 399/111 |
| 2009/0016768 | A1 * | 1/2009 | Seorl et al. | 399/107 |
| 2009/0142096 | A1 * | 6/2009 | Greywall et al. | 399/119 |
| 2009/0269100 | A1 * | 10/2009 | Hashimoto | 399/114 |
| 2009/0290904 | A1 * | 11/2009 | Kawai et al. | 399/111 |
| 2009/0317126 | A1 | 12/2009 | Tomatsu | |
| 2010/0054797 | A1 * | 3/2010 | Takeyama et al. | 399/111 |
| 2010/0129101 | A1 * | 5/2010 | Muto | 399/53 |
| 2011/0229194 | A1 | 9/2011 | Okabe et al. | |
| 2011/0311269 | A1 * | 12/2011 | Murooka | 399/110 |
| 2012/0039625 | A1 * | 2/2012 | Sekido et al. | 399/110 |
| 2012/0183327 | A1 * | 7/2012 | Watanabe et al. | 399/111 |

FOREIGN PATENT DOCUMENTS

| | | | |
|---|---|---|---|
| JP | 2006-065267 | A | 3/2006 |
| JP | 2006-171407 | A | 6/2006 |
| JP | 2010-002626 | A | 1/2010 |
| JP | 2011-133914 | A | 7/2011 |
| JP | 2011-197408 | A | 10/2011 |

* cited by examiner

*Primary Examiner* — David Bolduc
(74) *Attorney, Agent, or Firm* — Banner & Witcoff, Ltd.

(57) ABSTRACT

There is provided an image forming apparatus includes an apparatus body having an opening, an open/close member which opens and closes the opening, and an image forming unit which is drawable to an outside of the apparatus body through the opening. The open/close member includes a restraint member which is movable between a restraint position of restraining movement of the image forming unit and a restraint release position of releasing the restraint, and a moving member which moves the restraint member from the restraint position toward the restraint release position as the open/close member being moved from a close position to an open position. Once the restraint member is moved from the restraint position toward the restraint release position, the restraint member is held at the restraint release position not to be moved from the restraint release position to the restraint position even when the open/close member is moved.

11 Claims, 11 Drawing Sheets

IMAGE FORMING APPARATUS

CROSS-REFERENCE TO RELATED APPLICATION

This application claims priority from Japanese Patent Application No. 2012-018908, filed on Jan. 31, 2012, the entire subject matter of which is incorporated herein by reference.

TECHNICAL FIELD

Aspects of the present invention relate to an image forming apparatus of an electrophotographic type.

BACKGROUND

There has been known an image forming apparatus of an electrophotographic type in which a photosensitive member unit having a photosensitive member for forming a developer image thereon is removably mounted.

For example, a laser printer has an image forming unit which holds four process units for black, yellow, magenta and cyan, respectively (for example, refer to JP-A-2010-2626).

In this laser printer, the image forming unit has a notched part, which is notched forward, at a rear end thereof, and a support shaft, which protrudes outward in the left-right direction, at a front end thereof.

The body frame includes a body reference shaft, to which the notched part of the image forming unit is engaged, a support shaft insertion hole, into which the support shaft of the image forming unit is engaged, and a lock member which presses the support shaft rearward in conjunction with a closing operation of a door of the body frame.

In this laser printer, when the image forming unit is transported while being accommodated in the body frame at shipment of the laser printer, for example, the image forming unit may rattle due to shock from the outside during the transport.

Therefore, in order to buffer the shock from the outside, it is considered to fill a buffer material of foamed polystyrene and the like between the image forming unit and the body frame.

In this case, however, it is necessary to remove all the buffer material when setting up the laser printer, so that the setup operation of the laser printer would be cumbersome.

SUMMARY

Accordingly, it is an aspect of the present invention to provide an image forming apparatus which can be transported while suppressing an image forming unit from rattling in an apparatus body and can be easily set up.

According to an illustrative embodiment of the present invention, there is provided an image forming apparatus including an apparatus body having an opening, an open/close member which is provided to the apparatus body to be rotatable between an open position at which the open/close member opens the opening and a close position at which the open/close member closes the opening, and an image forming unit which is provided in the apparatus body to be drawable to an outside of the apparatus body through the opening.

The open/close member includes a restraint member which is movable between a restraint position at which the restraint member contacts the image forming unit to restrain movement of the image forming unit and a restraint release position at which the contact of the restraint member with the image forming unit is released to release the restraint on the image forming unit, and a moving member which is configured to move the restraint member from the restraint position toward the restraint release position as the open/close member being moved from the close position to the open position.

Once the restraint member is moved from the restraint position toward the restraint release position, the restraint member is held at the restraint release position so as not to be moved from the restraint release position to the restraint position even when the open/close member is moved.

According to the above configuration, when transporting the image forming apparatus, the restraint member for the open/close member is arranged at the restraint position and is thus brought into contact with the image forming unit accommodated in the apparatus body. Thereby, it is possible to transport the image forming apparatus while suppressing the image forming unit from rattling in the apparatus body.

Also, when setting up the image forming apparatus, the open/close member is moved from the close position to the open position. Then, the restraint member is held at the restraint release position. Therefore, it is possible to release the restraint on the image forming unit with the simple operation.

As a result, it is possible to transport the image forming apparatus while suppressing the image forming unit from rattling in the apparatus body and to easily set up the image forming apparatus.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIGS. 2A and 2B show a process unit shown in FIG. 1, wherein FIG. 2A is a perspective view of the process unit seen from the left-upper side, and FIG. 2B is a perspective view of the process unit seen from the left-lower side;

DETAILED DESCRIPTION

1. Overall Configuration of Printer

Figure 1:
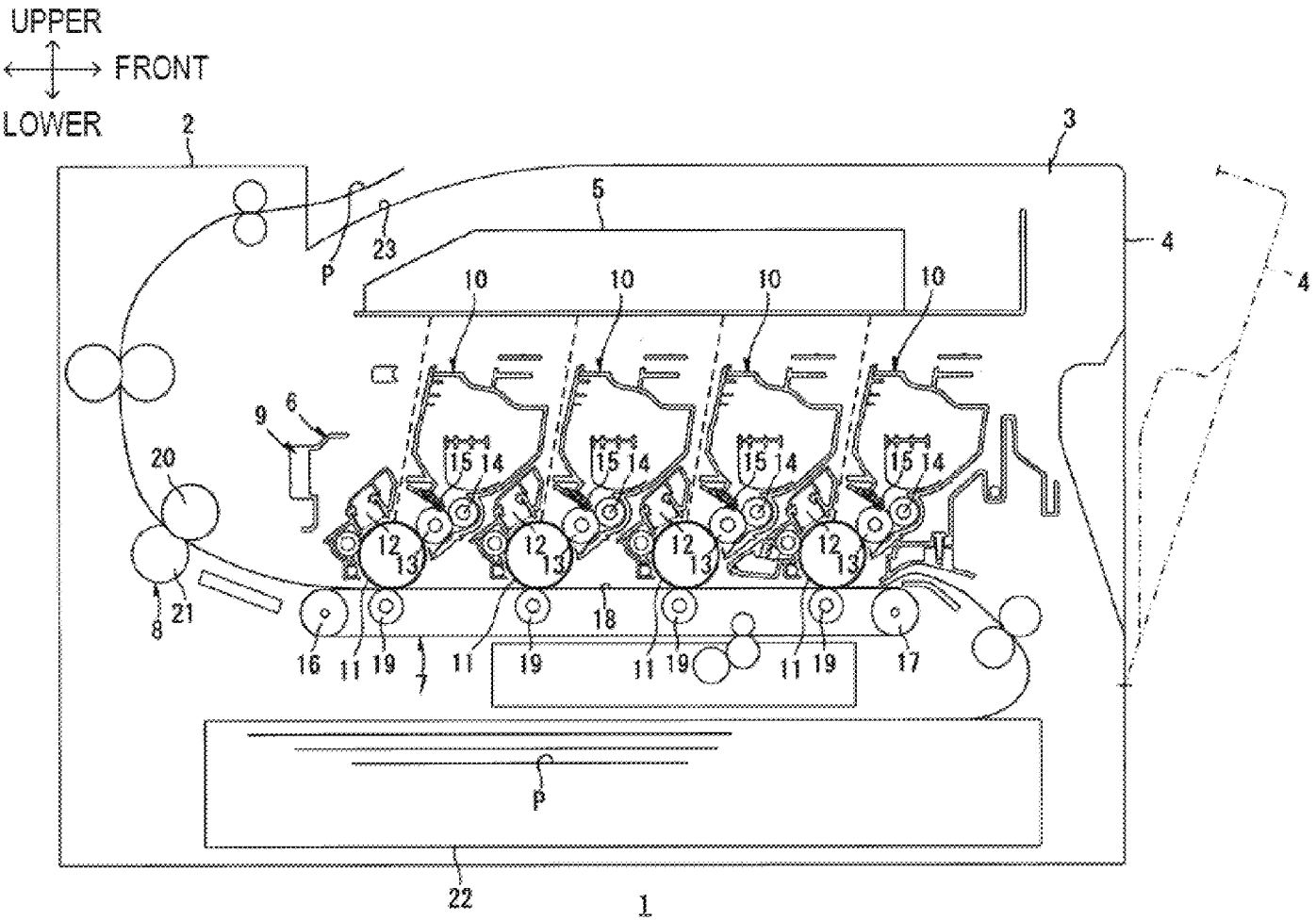
FIG. 1 is a sectional view of a printer according to an illustrative embodiment of the present invention.

Referring to FIG. 1, a printer 1 (an example of an image forming apparatus) is a direct tandem color laser printer of a horizontal arrangement type.

In the below descriptions, the directions are described on the basis of a state where the printer 1 is horizontally placed. That is, the right side of FIG. 1 is referred to as a front and the left side of FIG. 1 is referred to as a rear. Also, the left and the right are described on the basis of a state where the printer 1 is seen from the front. That is, the front side of FIG. 1 is a left and the back side of FIG. 1 is a right.

The printer 1 has a body casing 2 (an example of an apparatus body) having a substantially box shape. A front end portion of the body casing 2 is formed with a body opening 3 (an example of an opening) which allows the inside and outside of the body casing 2 to communicate with each other. Also, a front wall of the body casing 2 is provided with a front cover 4 (an example of an open/close member) which opens and closes the body opening 3.

Also, the printer 1 has, in the body casing 2, a scanner unit 5, a process unit 6 (an example of an image forming unit), a transfer unit 7 and a fixing unit 8.

The scanner unit 5 is arranged at an upper part of the body casing 2. The scanner unit 5 emits laser beams toward photosensitive drums 11 (which will be described later) of the process unit 6 (refer to the dotted line in FIG. 1), based on image data, thereby exposing the photosensitive drums 11.

The process unit 6 is arranged below the scanner unit 5 and above the transfer unit 7. The process unit 6 is provided to be slidable in the front-rear direction and can be drawn to the outside of the body casing 2 via the body opening 3. The process unit 6 has one process frame 9 and four developing cartridges 10.

The process frame 9 has a plurality (four) of photosensitive drums 11 (an example of an image carrier) and a plurality (four) of scorotron-type chargers 12.

The respective photosensitive drums 11 correspond to a plurality (four) of colors (black, yellow, magenta and cyan), respectively and are arranged in parallel with each other at an interval in the front-rear direction. The photosensitive drum 11 has a cylindrical shape which is long in the left-right direction and is rotatably supported to the process frame 9.

The respective scorotron-type chargers 12 are provided in correspondence to the plurality of photosensitive drums 11, respectively. The scorotron-type charger 12 is arranged to oppose the corresponding photosensitive drum 11 at an interval at the rear-upper side of the photosensitive drum.

The plurality of developing cartridges 10 are provided in correspondence to the plurality of photosensitive drums 11, respectively. The developing cartridge 10 is detachably supported to the process frame 9 at the upper of the corresponding photosensitive drum 11. Also, each of the developing cartridges 10 has a developing roller 13.

The developing roller 13 is rotatably supported at a lower end portion of the developing cartridge 10 such that it is exposed from the rear. Also, the developing roller 13 contacts the photosensitive drum 11 from the upper of the photosensitive drum.

In the meantime, the developing cartridge 10 has a supply roller 14 which supplies toner (an example of developer) to the developing roller 13 and a layer thickness regulation blade 15 which regulates a thickness of the toner supplied to the developing roller 13. Also, the toner which corresponds to each color is accommodated in an upper space of the developing cartridge 10.

The transfer unit 7 is arranged at the lower of the process unit 6. The transfer unit 7 has a driving roller 16, a driven roller 17, a conveyance belt 18 (an example of a belt) and a plurality (four) of transfer rollers 19.

The driving roller 16 is arranged at a rear end portion of the transfer unit 7.

The driven roller 17 is arranged at a front end portion of the transfer unit 7 such that it is arranged to oppose the driving roller 16 at an interval at the front of the driving roller.

The conveyance belt 18 is wound around the driving roller 16 and the driven roller 17 such that an upper part of the belt contacts all the photosensitive drums 11. The conveyance belt 18 circulates such that the upper part thereof moves from the front toward the rear as the driving roller 16 drives and the driven roller 17 is driven.

The respective transfer rollers 19 are provided in correspondence to the plurality of photosensitive drums 11 between the driving roller 16 and the driven roller 17, respectively. The transfer roller 19 is arranged to oppose the corresponding photosensitive drum 11 with the upper part of the conveyance belt 18 being interposed therebetween. The transfer roller 19 is applied with a transfer bias.

The fixing unit 8 is arranged at the rear of the transfer unit 7 and has a heating roller 20 and a pressing roller 21 which opposes the heating roller 20.

When an image forming operation of the printer 1 starts, the toner in the developing cartridge 10 is positively friction-charged between the supply roller 14 and the developing roller 13 and is carried on a surface of the developing roller 13 as a thin layer having a predetermined thickness by the layer thickness regulation blade 15.

In the meantime, a surface of the photosensitive drum 11 is uniformly charged by the scorotron-type charger 12, which is arranged to oppose the photosensitive drum 11 at the rear-upper side of the photosensitive drum, and is then exposed based on predetermined image data by the scanner unit 5. Thereby, an electrostatic latent image based on the image data is formed. The toner carried on the developing roller 13 is then supplied to the electrostatic latent image on the photosensitive drum 11, so that a toner image (developer image) is carried on the surface of the photosensitive drum 11.

A sheet P (an example of a member to be transferred) is accommodated in a sheet feeding tray 22 which is provided at a bottom part of the body casing 2, and is conveyed to U-turn toward the rear-upper side by the respective rollers, so that the sheet P is fed one by one between the photosensitive drums 11 and the conveyance belt 18 at a predetermined timing. Then, the sheet P is conveyed from the front toward the rear between the photosensitive drums 11 and the transfer rollers 19 by the conveyance belt 18. At this time, the toner image is transferred to the sheet P by the transfer bias.

Then, the sheet P having the toner image transferred thereto is heated and pressurized when passing between the heating roller 20 and the pressing roller 21. At this time, the toner image is heat-fixed on the sheet P.

After that, the sheet P is conveyed to U-turn toward the front-upper side and is then discharged onto a sheet discharge tray 23 which is provided on an upper surface of the body casing 2.

2. Details of Process Cartridge

Figure 2A:
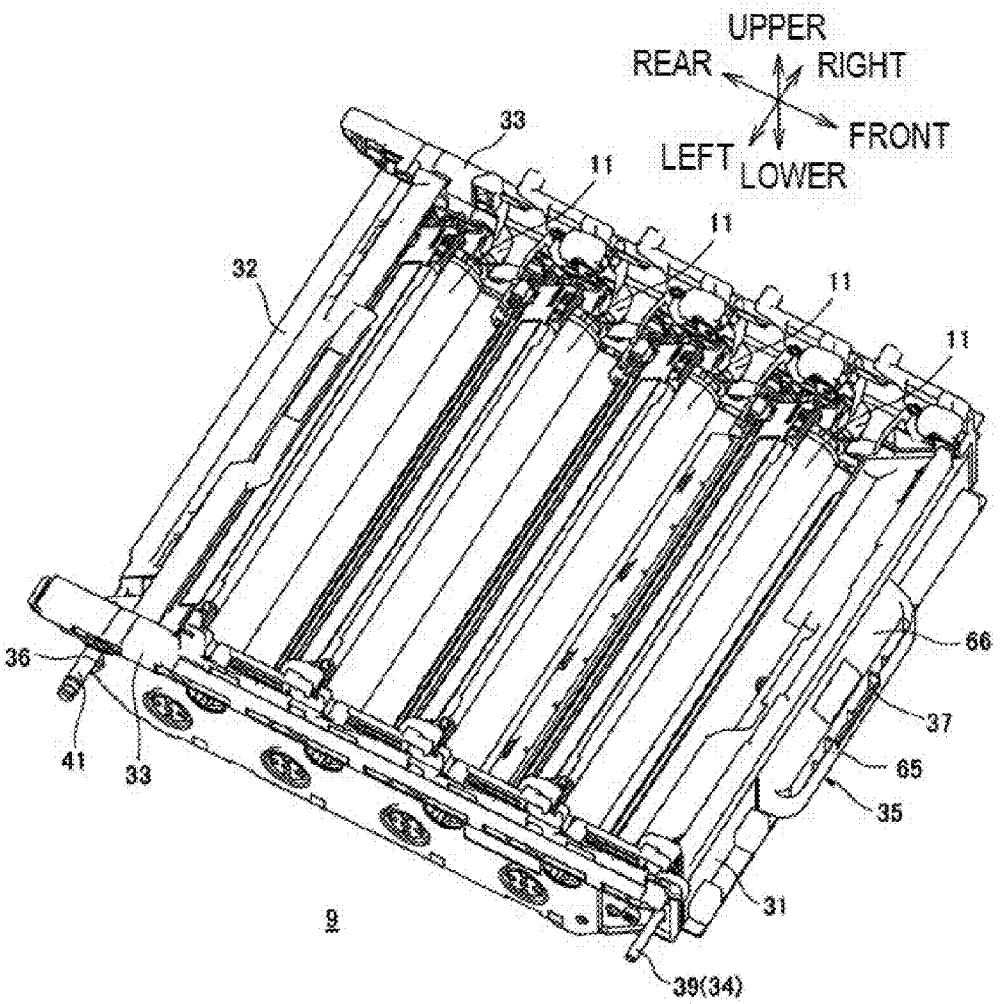
Figure 2B:
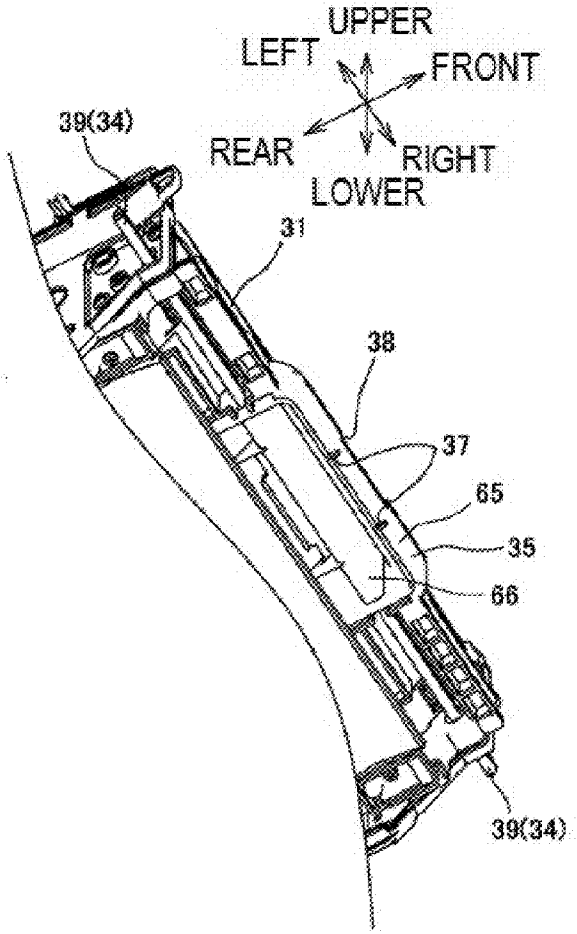

As shown in FIGS. 2A and 2B, the process frame 9 has a substantially rectangular frame shape, when seen from the plan view, and has a front beam 31, a rear beam 32, a pair of left and right side plates 33 and a positioning shaft 34.

The front beam 31 has a substantially flat plate shat extending in the upper-lower and left-right directions and is provided between front ends of the pair of side plates 33. Also, the front beam 31 has a grip part 35.

The grip part 35 is provided at a center of the front beam 61 in the left-right direction. The grip part 35 has a grip part body 66 and a contacted part 65.

The grip part body 66 expands from a front surface of the front beam 31 toward the front and has a substantially rectangular shape, when seen from the plan view extending in the left-right direction.

The contacted part 65 continues from a front side of the grip part body 66. The contacted part 65 extents in the left-right direction and has a substantial arch shape at both left and right end portions thereof continuing from both left and right end portions of the grip part body 66, when seen from the plan view. The contacted part 65 has a positioning recess 38 and a pair of left and right positioning ribs 37.

The positioning recess 38 has a substantial U shape opening upward when seen from the front so that it is notched downward from an upper end edge of the grip part 35 at a substantial center of the contacted part 65 in the left-right direction. A length of the positioning recess 38 in the left-right direction is longer than a length of a first holding member 52 (which will be described later) of the front cover 4 in the left-right direction.

The positioning ribs 37 are formed as projections which protrude downward from a lower end edge of the grip part 35 at a substantial center of the contacted part 65 in the left-right direction and extend in the front-rear direction. Also, the positioning ribs 37 are arranged to oppose each other at an interval in the left-right direction. An interval of the positioning ribs 37 in the left-right direction is longer than a length of a second holding member 53 (which will be described later) of the front cover 4 in the left-right direction.

The rear beam 32 has a substantially flat plate shape extending in the upper-lower and left-right directions and is provided between rear ends of the pair of side plates 33.

The pair of side plates 33 is arranged to oppose each other at an interval in the left-right direction. The side plate 33 extends in the upper-lower and left-right directions and has a substantially rectangular shape that is long in the front-rear direction, when seen from the side. The side plate 33 is formed with a notched part 36.

The notched part 36 is notched into a substantial V shape having a rear side opening forward from a rear end edge of the side plate 33. The notched part 36 receives a body reference shaft 41 (which will be described later) provided in the body casing 2 when the process unit 6 is mounted to the body casing 2.

The positioning shaft 34 has a substantially cylindrical shape extending in the left-right direction such that it passes through the front beam 31 and the front end portions of the pair of side plates 33. Both left and right end portions of the positioning shaft 34 protrude outward from the front end portion of the side plate 33 in the left-right direction. In the meantime, both left and right end portions of the positioning shaft 34 serve as contact parts 39 which are brought into contact with positioning shaft support parts 42 (which will be described later) of the body casing 2 when the process unit 6 is arranged at a mount position (which will be described later).

3. Details of Body Casing (1) Front Cover

Figure 3:
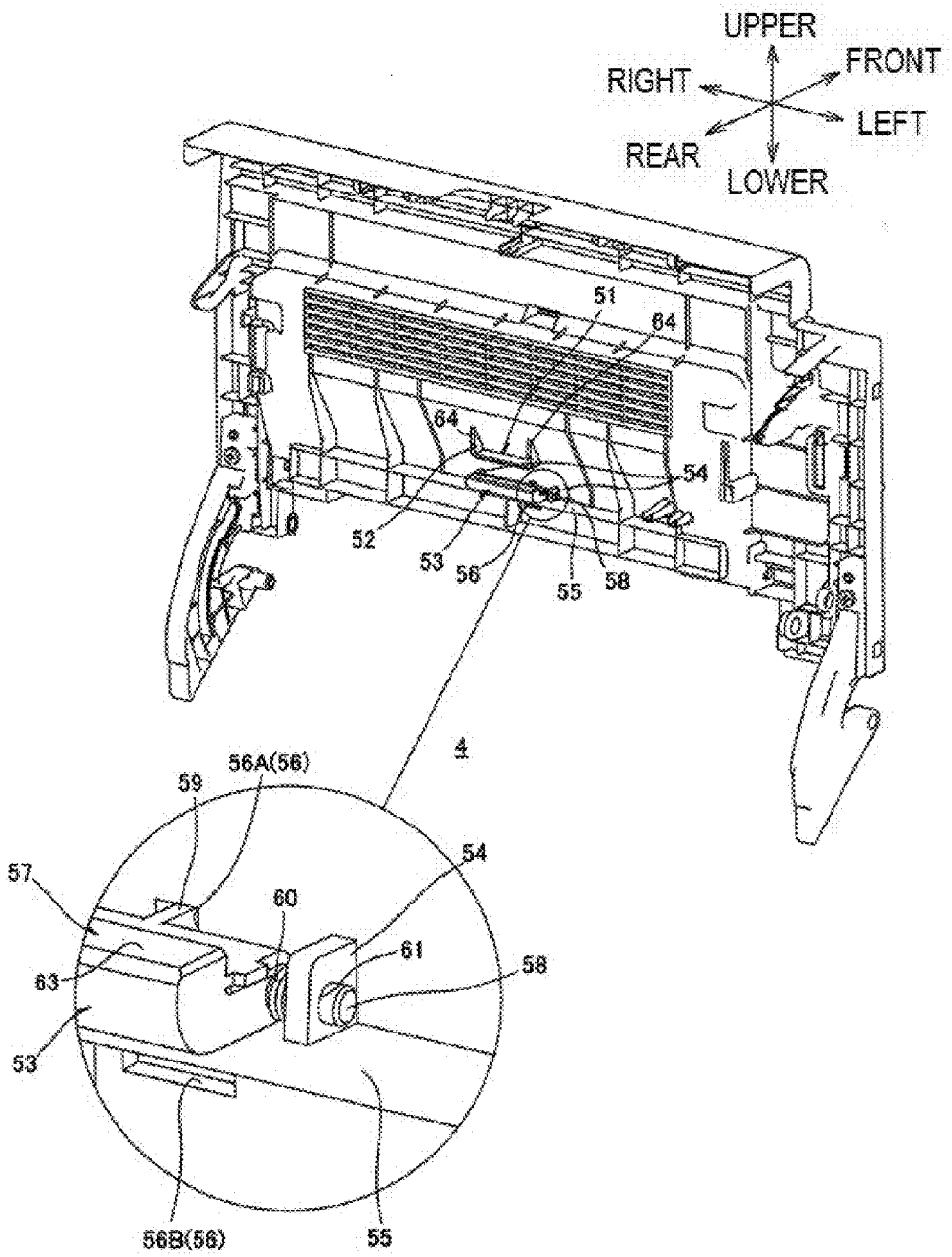
FIG. 3 is a perspective view of a front cover shown in FIG. 1, which is seen from the left-rear side and shows a state where a second holding member is arranged at a restraint position.
Figure 4:
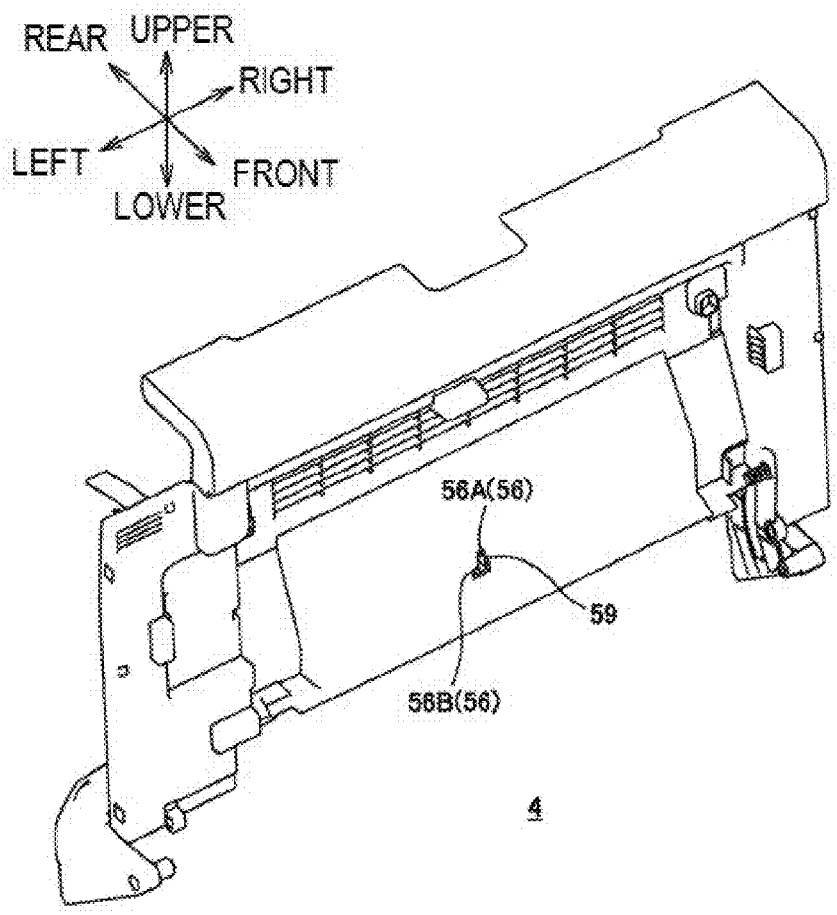
FIG. 4 is a perspective view of the front cover shown in FIG. 3, which is seen from the left-front side.
Figure 5:
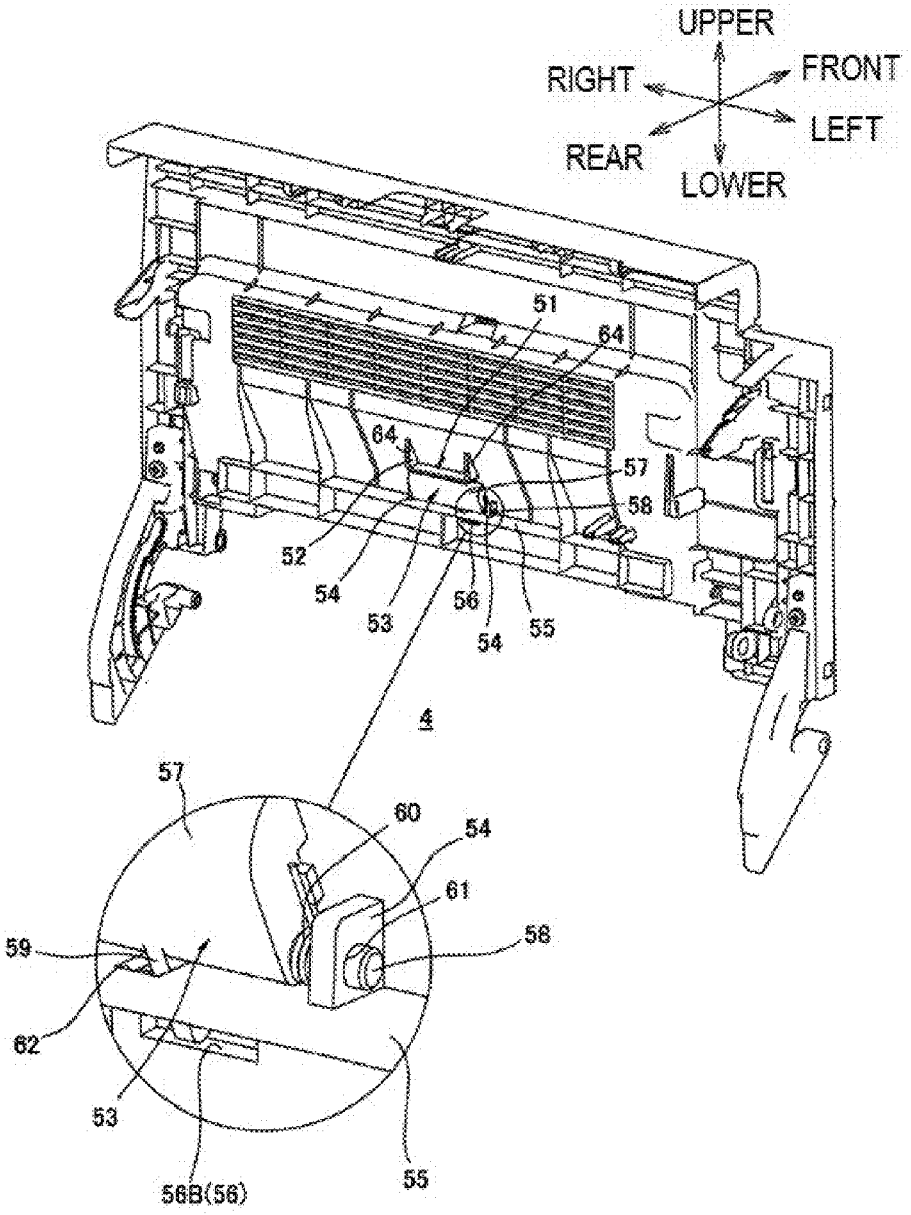
FIG. 5 is a perspective view of the front cover shown in FIG. 1, which is seen from the left-rear side and shows a state where the second holding member is arranged at a restraint release position.

As shown in FIGS. 3 to 5, the front cover 4 has a substantially flat plate shape extending in the left-right direction. The front cover 4 is rotated about a lower end portion thereof between an open position (refer to FIG. 8) at which the front cover opens the body opening 3 and a close position (refer to FIG. 6) at which the front cover closes the body opening 3.

Also, the front cover 4 has a holding (sandwiching) part 51 which holds (sandwiches) the grip part 35 of the process frame 9.

The holding part 51 is provided at a lower side of the center of the front cover 4 in the left-right direction. The holding part 51 has a first holding member 52, a restraint rib 55 (an example of an opposing member), a pair of left and right support parts 54, an exposing opening 56 and a second holding member 53 (an example of a restraint member).

The first holding member 52 is provided at the center of the front cover 4 in the left-right direction. The first holding member 52 has a substantial U shape which protrudes rearward from a rear surface of the front cover 4 and opens upward, when seen from the rear side. Also, the first holding member 52 has contact ribs 64.

The contact ribs 64 are respectively provided at left and right end portions of the first holding member 52 at upper halves thereof. The contact ribs 64 are formed as projections which protrude rearward from the rear surface of the first holding member 52 and extend in the upper-lower direction.

The restraint rib 55 is arranged to oppose the first holding member 52 at an interval at the lower of the first holding member 52. The restraint rib 55 is formed as a projection which protrudes rearward from the rear surface of the front cover 4 and extends in the left-right direction. The restraint rib 55 is formed with an accommodation recess 62 (refer to FIG. 5) which accommodates therein an operation part 59 (which will be described later).

The accommodation recess 62 is a through-hole having a substantially rectangular shape, when seen from the plan view, at the substantial center of the restraint rib 55 in the left-right direction and continues, at a front end portion thereof, to a first part 56A (which will be described later) of the exposing opening 56.

The pair of support parts 54 are arranged to oppose each other at an interval in the left-right direction above the restraint rib 55 and below the first holding member 52. The support part 54 has a substantially rectangular flat plate shape when seen from the side such that the support part 54 protrudes rearward from the rear surface of the front cover 4 and continues to an upper surface of the restraint rib 55 at a lower end portion of the support part. The support part 54 is formed with an insertion hole 61 into which a support boss 58 is inserted.

The insertion hole 61 is a through-hole having a substantially circular shape, when seen from the side, which is formed at a center of the support part 54 in the front-rear and upper-lower directions and has the substantially same diameter as (slightly larger than) an outer diameter of the support boss 58.

The exposing opening 56 is a thorough-hole having a substantial T shape when seen from the side, which is formed at the center of the front cover 4 in the left-right direction. Specifically, the exposing opening 56 has a first part 56A and a second part 56B.

The first part 56A has a substantially linear shape extending in the upper-lower direction. An upper end portion of the first part 56A is arranged above an upper surface of a front end portion of the second holding member 53. Also, a lower end portion of the first part 56A is arranged below the restraint rib 55.

The second part 56B has a substantially linear shape extending in the left-right direction. The second part 56B continues from a lower end portion of the first part 56A at a substantial center thereof in the left-right direction.

The second holding member 53 is arranged between the pair of support parts 54 below the first holding member 52. The second holding member 53 has a body part 57, the support bosses 58 and the operation part 59.

The body part 57 has a substantially L-shaped flat plate shape when seen from the side which extends in the left-right direction and a rear end portion thereof is bent upward. An upper end surface of the rear end portion of the body part 57 becomes a contact surface 63 which is brought into contact with the grip part 35 of the process frame 9 from the lower of the grip part 35.

The support boss 58 has a substantially cylindrical shape which extends outward in the left-right direction from both left and right end portions of a front end portion of the body part 57.

The operation part 59 has a substantial rod shape which extends forward from a center of the front end portion of the body part 57 in the left-right direction.

The second holding member 53 is supported to the rear of the front cover 4 such that the support bosses 58 are rotatably inserted into the insertion holes 61 of the support parts 54.

Thereby, the second holding member 53 can be rotated about a central axis line of the support bosses 58 between a restraint position (refer to FIG. 3) at which the second holding member is rearward tilted and a restraint release position (refer to FIG. 5) at which the second holding member is upward erected.

When the second holding member 53 is arranged at the restraint position, the contact surface 63 of the second holding member 53 opposes the first holding member 52 at an interval of an upper-lower length, which is substantially same as (slightly longer than) an upper-lower length of the grip part 35 of the process frame 9. In the meantime, the second holding member 53 is retrained from rotating further downward by the restraint rib 55 (refer to FIG. 7).

At this time, a front end portion of the operation part 59 of the second holding member 53 is arranged in the first part 56A of the exposing opening 56 and protrudes forward from the front surface of the front cover 4 through the exposing opening 56.

When the second holding member 53 is arranged at the restraint release position, the contact surface 63 of the second holding member 53 is brought into contact with the rear surface of the front cover 4 around the lower of the first holding member 52.

At this time, the front end portion of the operation part 59 of the second holding member 53 is arranged in the second part 56B of the exposing opening 56 and is accommodated in the exposing opening 56.

Also, the second holding member 53 is always urged toward the restraint release position by a coil spring 60 (an example of a moving member and an urging member).

The coil spring 60 is wound on the support boss 58 of the second holding member 53 and has one end portion which is engaged to the second holding member 53 and the other end portion (not shown) which is engaged to the restraint rib 55 of the front cover 4.

(2) Body Reference Shaft and Body Reference Surface

Figure 6:
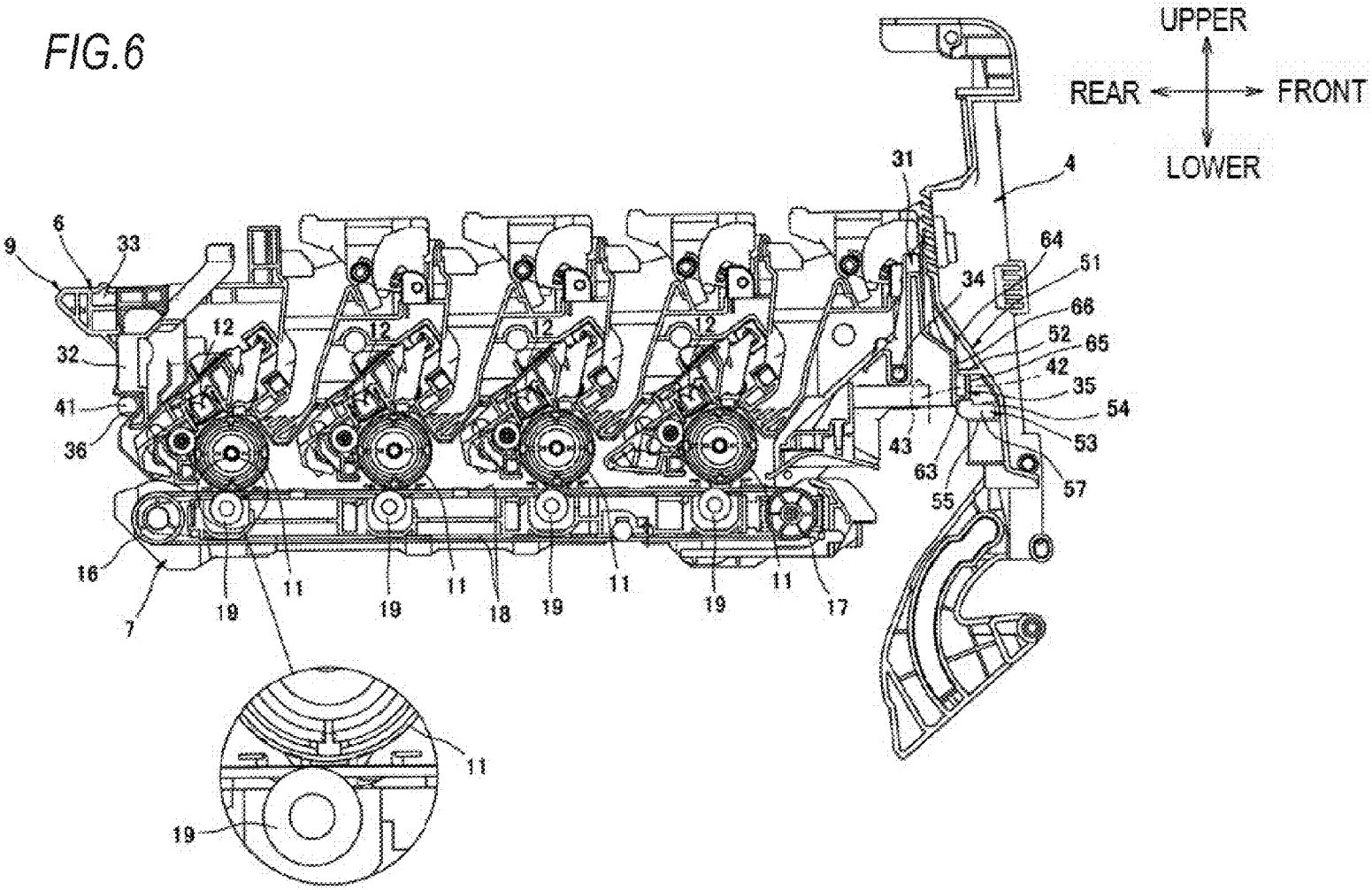
FIG. 6 shows a positioning of the process unit in a body casing and shows a state where the front cover is arranged at a close position, the second holding member is arranged at the restraint position and the process unit is arranged at a transport position.

As shown in FIG. 6, the body casing 2 is provided therein with the body reference shaft 41 and the positioning shaft support parts 42 (an example of a positioning part).

The body reference shaft 41 is provided in the rear end portion of the body casing 2 and has a substantially cylindrical shape extending in the left-right direction such that it extends between both left and right sidewalls of the body casing 2.

The positioning shaft support parts 42 are provided at both left and right sidewalls of the body casing 2, respectively. An upper surface of the positioning shaft support part 42 is a planar surface extending in the front-rear and left-right directions and serves as a body reference surface 43 which supports the positioning shaft 34 of the process frame 9.

4. Positioning of Process Unit

As shown in FIG. 6, when transporting the printer 1 while the process unit 6 being accommodated in the body casing 2, for example, at shipment of the printer 1, the process unit 6 is accommodated in the body casing 2 and all the photosensitive drums 11 are positioned at transport positions spaced upward from the conveyance belt 18.

In order to accommodate the process unit 6 in the body casing 2, the front cover 4 is first arranged at the open position, the process unit 6 is inserted in the body casing 2 from the rear end portion thereof such that the notched parts 36 of the side plates 33 engages with the body reference shaft 41 in the radial direction of the body reference shaft 41.

Thereby, the process unit 6 is retrained from moving in the upper-lower direction and rearward at the rear end portion thereof.

Then, a plate-shaped jig (not shown) is engaged in the second part 56B of the exposing opening 56, so that the operating part 59 is held in the first part 56A of the exposing opening 56 against the urging force of the coil spring 60 and the second holding member 53 is held at the restraint position.

After that, the front cover 4 is moved from the open position to the close position while lifting up the front end portion of the process unit 6 and the contacted part 65 of the process unit 6 is arranged between the first holding member 52 and second holding member 53 of the front cover 4.

Specifically, the rear-lower end portion of the first holding member 52 is engaged in the positioning recess 38 of the contacted part 65. Also, the rear end portion of the second holding member 53 is engaged between the pair of positioning ribs 37 of the contacted part 65 such that the contact surface 63 is brought into contact with the lower surface of the contacted part 65 from the lower side of the contacted part 65.

Thereby, the front end portion of the process unit 6 is retrained from moving in the upper-lower direction and in the left-right direction in the body casing 2. Meanwhile, at this state, the contact parts 39 of the positioning shaft 34 of the process unit 6 are spaced upward from the body reference surface 43 of the body casing 2.

Then, the front cover 4 is arranged at the close position. Thereby, the contact ribs 64 of the first holding member 52 are brought into contact with the front surface of the grip part body 66 from the front side of the grip part body 66.

Thereby, the front end portion of the process unit 6 is retrained from moving forward in the body casing 2.

After that, when the jig (not shown) engaged in the second part 56B of the exposing opening 56 is removed, the accommodation of the process unit 6 into the body casing 2 is completed.

Figure 8:
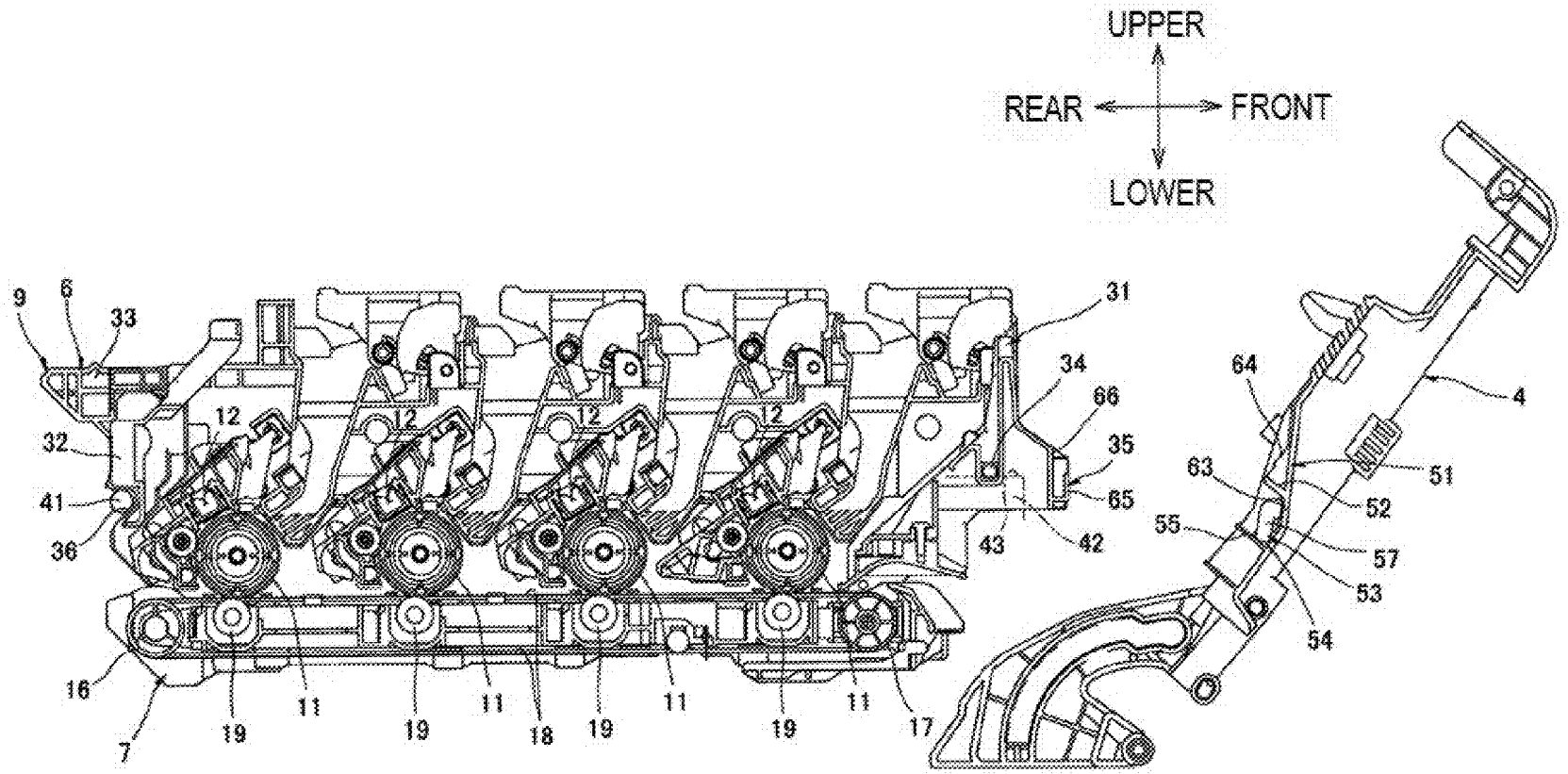
FIG. 8 shows a positioning of the process unit in the body casing and shows a state where the front cover is moved from the close position to an open position, the second holding member is arranged at the restraint release position, and the process unit is arranged at a mount position.

In the meantime, in order to set up the printer 1 to form an image, the printer 1 is placed on a predetermined horizontal surface and then the front cover 4 is moved from the close position toward the open position, as shown in FIG. 8.

Thereby, the front cover 4 is rotated, so that the first holding member 52 and second holding member 53 are spaced forward from the contacted part 65. As a result, the engagement of the first holding member 52 in the positioning recess 38 is released and the contact of the second holding member 53 with the contacted part 65 is released.

Thereby, the restraint on the front end portion of the process unit 6 by the first holding member 52 and second holding member 53 is released. Also, the second holding member 53 of the front cover 4 is moved from the restraint position to the restraint release position and is then held (kept) at the restraint release position by the urging force of the coil spring 60.

Then, the front end portion of the process unit 6 is rotated downward due to its weight and all the photosensitive drums 11 are brought into contact with the conveyance belt 18 from the upper of the conveyance belt.

At the same time, the contact parts 39 of the positioning shaft 34 of the process unit 6 are brought into contact with the body reference surface 43 of the body casing 2 from the upper side of the body reference surface. In the meantime, the notched parts 36 of the side plates 33 is kept being engaged with the body reference shaft 41 from the front of the body reference shaft 41.

Figure 9:
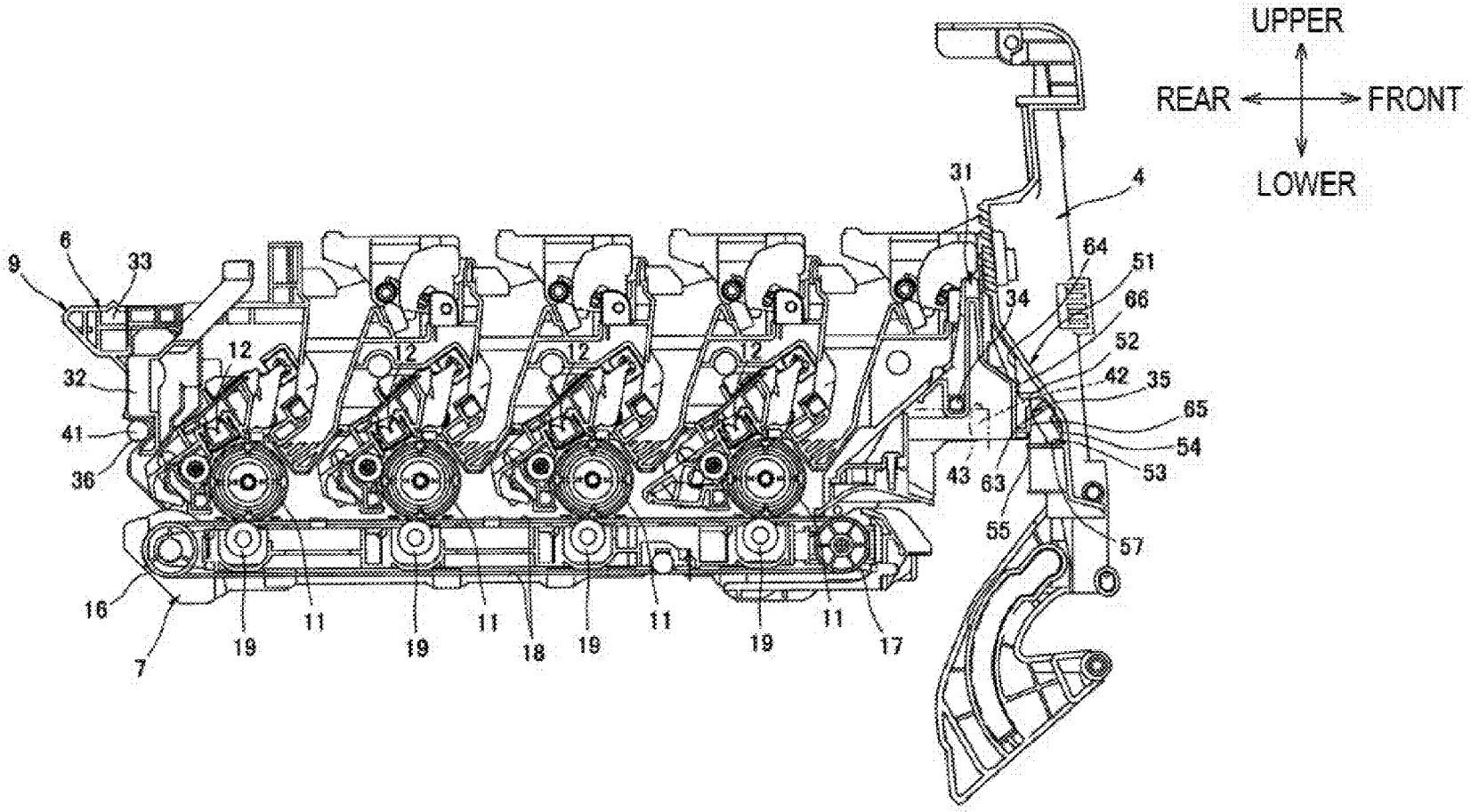
FIG. 9 shows a positioning of the process unit in the body casing and shows a state where the front cover is arranged at the close position, the second holding member is arranged at the restraint release position, and the process unit is arranged at the mount position.

After that, as shown in FIG. 9, when the front cover 4 is again moved to the close position, the setup of the printer is completed.

At this time, as disclosed in JP-A-2010-2626, lock members (not shown) interlocking with the opening and closing operations of the front cover 4 are engaged to both left and right end portions of the positioning shaft 4 of the process unit 6 and the process unit 6 is pressed rearward.

Thereby, the process unit 6 is pressed to the body reference shaft 41 from the front thereof at the notched parts of the side plates 33 and is thus positioned at the mount position at which an image can be formed.

Also, at this time, the second holding member 53 of the front cover 4 is held at the restraint release position by the coil spring 60 and is arranged to oppose the contacted part 65 at an interval at the front of the contacted part 65. That is, after the setup of the printer 1 is completed, the second holding member 53 is not moved from the restraint release position to the restraint position even when the front cover 4 is moved.

Also, the first holding member 52 of the front cover 4 is arranged to oppose the contacted part 65 at an interval at the upper of the contacted part 65. Also, the contact ribs 64 of the first holding member 52 are arranged to oppose the front end portion of the grip part body 66 at an interval at the upper of the front end portion.

That is, after the setup of the printer 1 is completed, the process unit 6 is held at the mount position without being again arranged at the transport position by the second holding member 53.

5. Operational Effects (1) According to the printer 1, as shown in FIG. 6, at transporting the printer 1, when the second holding member 53 of the printer 1 is arranged at the restraint position and the contacted part 65 of the process unit 6 accommodated in the body casing 2 is held (sandwiched) by the first holding member 52 and second holding member 53 of the front cover 4, it is possible to transport the printer while suppressing the process unit 2 from rattling in the body casing 2.

Also, as shown in FIG. 8, in setting up the printer 1, when the front cover 4 is moved from the close position to the open position, the second holding member 53 is held at the restraint release position by the urging force of the coil spring 60. Therefore, it is possible to release the restraint on the process unit 6 with the simple operation.

As a result, it is possible to transport the printer 1 while suppressing the process unit 6 from rattling in the body casing 2 and to easily set up the printer 1.

Further, after the setup of the printer 1 is completed, the second holding member 53 of the front cover 4 is held at the restraint release position by the coil spring 60.

Therefore, it is possible to keep the process unit 6 at the mount position at which an image can be formed, without again moving the process unit 6 at the transport position by the second holding member 53.

(2) Also, according to the printer 1, as shown in FIG. 6, the second holding member 53 may restrain, at the restraint position, the movement of the process unit 6 in the body casing 2 in a state where the front cover 4 is arranged at the close position.

Therefore, it is possible to suppress the process unit 6 from rattling in the body casing 2 in a state where the front cover 4 is arranged at the close position.

As a result, it is possible to transport the printer 1 while suppressing the process unit 6 from rattling in the body casing 2.

Figure 7:
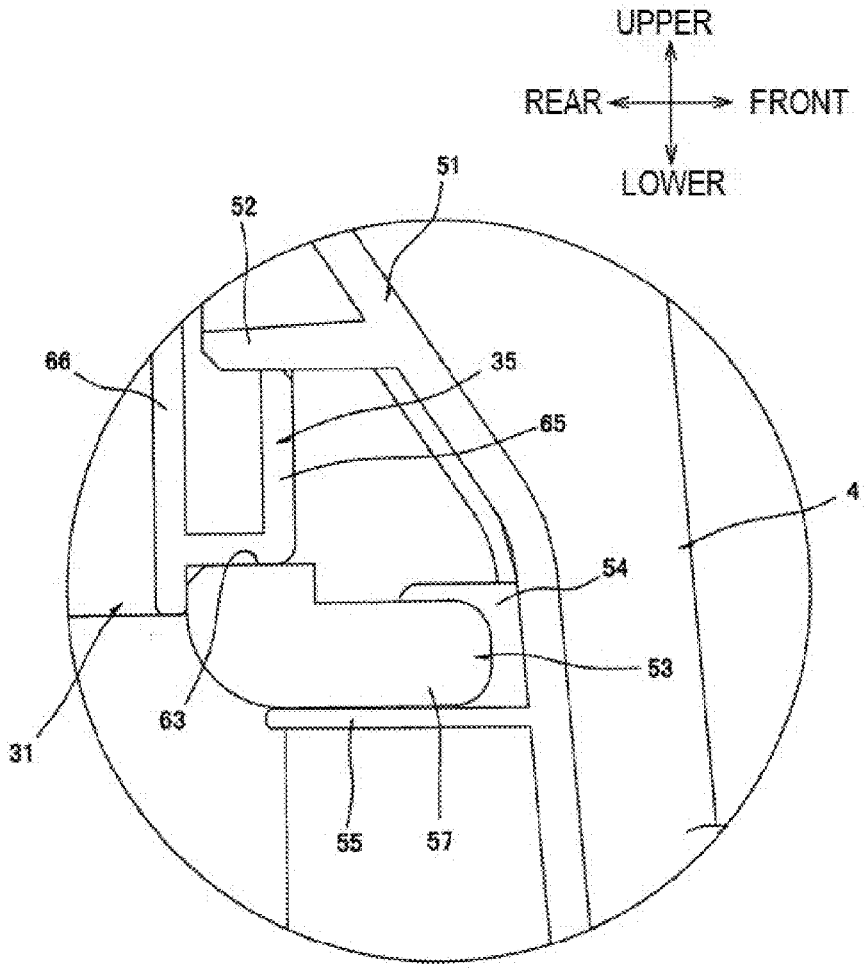
FIG. 7 is an enlarged view of the second holding member shown in FIG. 6.

(3) Also, according to the printer 1, as shown in FIG. 7, the restraint rib 55 which opposes the second holding member 53 from the lower of the second holding member may be provided.

Therefore, it is possible to restrain the second holding member 53 from moving further downward by the restraint rib 55.

As a result, it is possible to securely keep the second holding member 53 at the restraint release position.

(4) Also, according to the printer 1, as shown in FIG. 3, the coil spring 60 urges the second holding member 53 toward the restraint release position.

Therefore, it is possible to move the second holding member 53 from the restraint position toward the restraint release position, and thus, to securely keep the second holding member 53 at the restraint release position with the simple configuration.

(5) Also, according to the printer 1, as shown in FIG. 6, when transporting the printer 1, it is possible to restrain the process unit 6 at the transport position and to thus transport the printer while suppressing the process unit 6 from rattling in the body casing 2.

Also, as shown in FIGS. 8 and 9, when setting up the printer 1, it is possible to release the restraint on the process unit 6 and to thus mount the process unit 6 to the body casing 2 at the mount position at which an image can be formed.

As a result, when conveying the printer 1, it is possible to securely suppress the process unit 6 from rattling in the body casing 2, and when setting up the printer 1, it is possible to mount the process unit 6 to the body casing 2 such that an image can be formed with the simple configuration.

(6) Also, according to the printer 1, as shown in FIG. 6, when transporting the printer 1, it is possible to separate all the photosensitive drums 11 from the conveyance belt 18.

Thereby, it is possible to prevent the photosensitive drums 11 from rubbing against the conveyance belt 18 and to thus prevent the surfaces of the photosensitive drums 11 and the conveyance belt 18 from being worn during the transport of the printer 1.

(7) Also, according to the printer 1, as shown in FIG. 6, it is possible to space the contact parts 39 of the positioning shaft 34 of the process unit 6 from the positioning shaft support parts 42 of the body casing 2 while transporting the printer 1.

Therefore, it is possible to suppress the contact parts 39 of the positioning shaft 34 of the process unit 6 from rubbing against the positioning shaft support parts 42 of the body casing 2 during the transport of the printer 1. Hence, it is possible to suppress the contact parts 39 of the positioning shaft 34 of the process unit 6 or the positioning shaft support parts 42 of the body casing 2 from being damaged.

As a result, it is possible to position the process unit 6 at the mount position with high precision.

(8) Also, according to the printer 1, as shown in FIG. 4, it is possible to easily move the second holding member 53 to the restraint position by operating the operation part 59 of the second holding member 53 at the front of the front cover 4 through the exposing opening 56 of the front cover 4.

Therefore, it is possible to improve the operability of the second holding member 53.

6. Modified Illustrative Embodiments (1) In the above illustrative embodiment, when transporting the printer 1, the process unit 6 is position-fixed with all the photosensitive drums 11 being spaced upward from the conveyance belt 18 by holding (sandwiching) the contacted part 65 of the process unit 6 with the first holding member 52 and second holding member 53 of the front cover 4.

Figure 10:
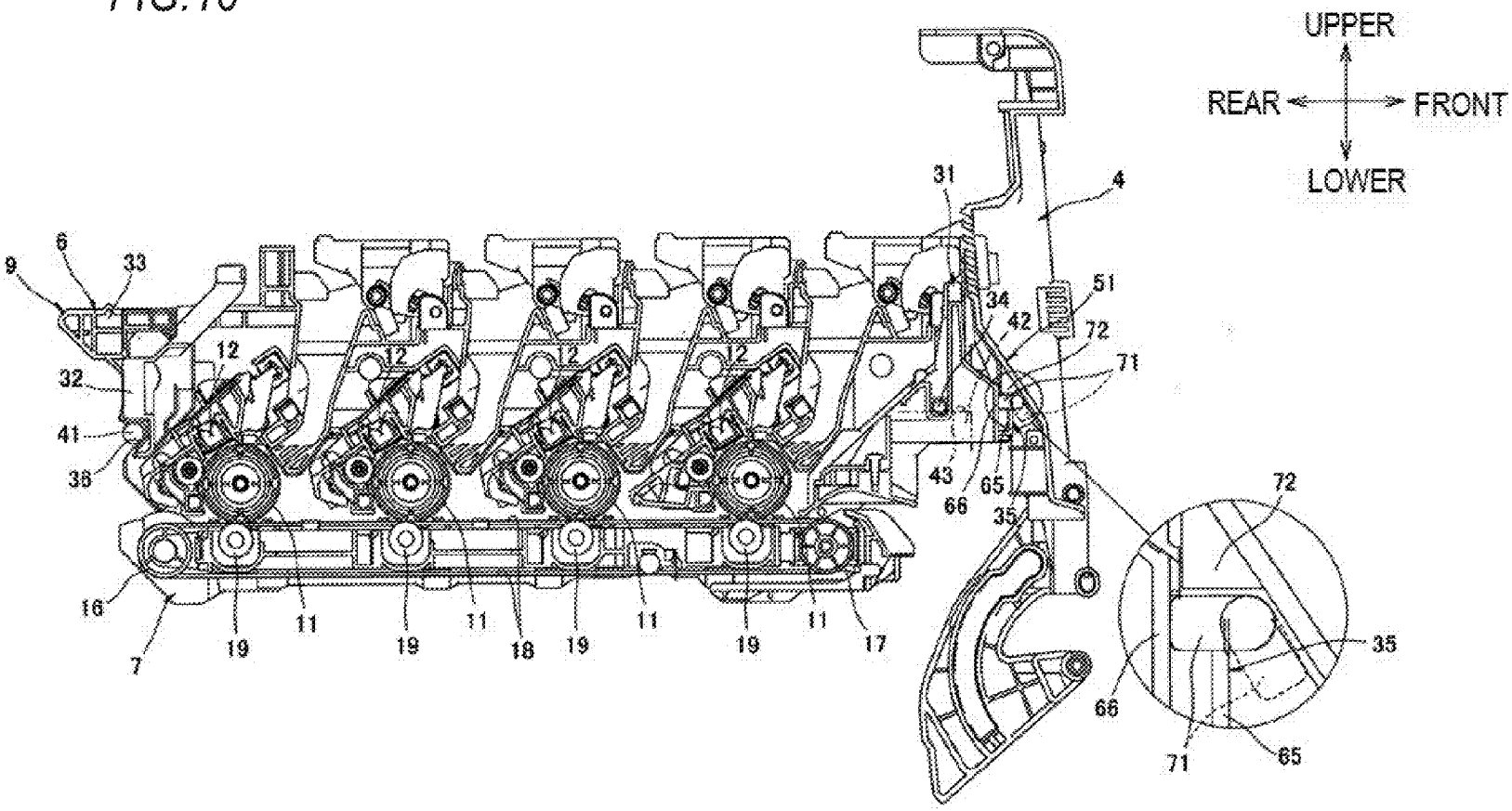
FIG. 10 shows a modified illustrative embodiment of the present invention and shows a positioning of the process unit in the body casing.

Compared to this, in this modified illustrative embodiment, as shown in FIG. 10, the front cover 4 is provided with a contact member 71 (an example of a restraint member) which contacts the contacted part 65 of the process unit 6 from the upper of the contacted part 65, instead of the second holding member 53 of the above illustrative embodiment. When transporting the printer 1, the process unit 6 is fixed at the mount position in the body casing 2.

The contact member 71 is arranged below a restraint rib 72 having the same shape as the first holding member 52 of the above illustrative embodiment. The contact member 71 has a substantially rectangular flat plate shape, when seen from the side, and can be rotated about a rear end portion at a restraint position between the restraint position (refer to the solid line in FIG. 10) extending in the front-rear direction and a restraint release position (refer to the dotted line in FIG. 10) extending in the upper-lower direction.

At the restraint position, the contact member 71 is engaged in the positioning recess 38 of the process unit 6 (refer to the enlarged view in FIG. 10) with being spaced slightly downward from the restraint rib 72. Also, at this time, the rear end portion of the contact member 71 is brought into contact with the front surface of the grip part body 66 from the front of the grip part body 66.

Thereby, the front end portion of the process unit 6 is restrained from moving in the left-right direction and forward in the body casing 2.

Also, the front end portion of the process unit 6 can just elastically move in the upper-lower direction only within the range of the interval between the contact member 71 and the restraint member 72 and is restrained from moving in the upper-lower direction beyond the range by the contact between the contact member 71 and the restraint member 72. That is, the contact member 71 is elastically brought into contact with the contacted part 65 of the process unit 6 in the upper-lower direction at the restraint position.

Also, the contact member 71 is arranged to follow the rear surface of the front cover 4 by the urging force of the coil spring 60 at the restraint release position.

Thereby, the contact member 71 is arranged at the front of the contacted part 65 of the process unit at an interval after the setup of the printer 1 is completed.

According to this modified illustrative embodiment, the contact member 71 is elastically brought into contact with the contacted part 65 of the process unit 6 in the upper-lower direction at the restraint position.

Therefore, in transporting the printer 1 with the process unit 6 being accommodated in the body casing 2, even when the shock is applied from the outside during the transport of the printer 1, it is possible to buffer the shock by the contact member 71.

Thereby, it is possible to suppress the process unit 6 from rattling in the body casing 2 and thus the process unit 6 from colliding with the body casing 2.

As a result, it is possible to suppress the process unit 6 and the body casing 2 from being damaged.

Also in this modified illustrative embodiment, it is possible to obtain the same operational effects as the above illustrative embodiment.

(2) Further, in the above illustrative embodiment and modified illustrative embodiment, the second holding member 53 and the contact member 71 may be formed of an elastic material such as rubber such that they can be elastically deformed.

Also in this case, it is possible to buffer the shock, which is applied from the outside during the transport of the printer 1, by the elasticity of the second holding member 53 or contact member 71.

As a result, it is possible to suppress the process unit 6 and the body casing 2 from being damaged.

(3) Further, in the above illustrative embodiment and modified illustrative embodiment, the second holding member 53 or contact member 71 is urged by the coil spring 60 (an example of a moving member and an urging member). However, the shape and material of the moving member and the urging member are not particularly limited. For example, an elastic member consisting of metal such as tension spring, compression spring, plate spring and the like or an elastic member consisting of resin such as sponge, rubber and the like may be also applied.

Also, when moving the front cover 4 from the close position to the open position without moving the second holding member 53 or contact member 71 by any urging member, the second holding member 53 or contact member 71 may be configured to move to the restraint release position by its own weight of the second holding member 53 or contact member 71. That is, the second holding member 53 or contact member 71 also serves as the moving member.

In this case, the second holding member 53 or contact member 71 is provided with an engaging part, the front cover 4 is provided with a part to be engaged to which the engaging part is engaged and the second holding member 53 or contact member 71 is moved to the restraint release position, so that the engaging part of the second holding member 53 or contact member 71 and an engaged part of the front cover 4 are engaged with each other. Thereby, the second holding member 53 or contact member 71 is held at the restraint release position.

The engaging part of the second holding member 53 or contact member 71 and the engaged part of the front cover 4 may be configured by hook-shaped members which can be engaged with each other or magnets which attract each other.

What is claimed is:

1. An image forming apparatus comprising:

an apparatus body having an opening;

an open/close member which is provided to the apparatus body to be rotatable between an open position at which the open/close member opens the opening and a close position at which the open/close member closes the opening; and an image forming unit which is provided in the apparatus body to be drawable to an outside of the apparatus body through the opening, wherein the open/close member includes:

a restraint member which is movable between a restraint position at which the restraint member contacts the image forming unit to restrain movement of the image forming unit and a restraint release position at which contact of the restraint member with the image forming unit is released to release the restraint on the image forming unit; and a moving member which is configured to move the restraint member from the restraint position toward the restraint release position as the open/close member moves from the close position to the open position, and wherein once the restraint member is moved from the restraint position toward the restraint release position, the restraint member is held at the restraint release position so as not to be moved from the restraint release position to the restraint position even when the open/close member is moved.

2. The image forming apparatus according to claim 1, wherein the restraint member restrains, at the restraint position, the image forming unit from moving in the apparatus body in a state where the open/close member is arranged at the close position.

3. The image forming apparatus according to claim 1, further comprising:

an opposing member which opposes the restraint member from an upstream side in a direction from the restraint position toward the restraint release position.

4. The image forming apparatus according to claim 1, wherein the moving member includes an urging member configured to urge the restraint member toward the restraint release position.

5. The image forming apparatus according to claim 4, wherein the restraint member is configured to elastically contact the image forming unit at the restraint position.

6. The image forming apparatus according to claim 1, wherein the restraint member is elastically deformable.

7. The image forming apparatus according to claim 1, wherein in the apparatus body, the image forming unit is movable between a transport position at which the image forming unit is arranged when transported together with the apparatus body and a mount position at which the image forming unit is mounted to the apparatus body such that an image can be formed, the transport position being different from the mount position, and wherein when the restraint member is arranged at the restraint position, the restraint member restrains the image forming unit at the transport position, and when the restraint member is arranged at the restraint release position, the restraint position allows the image forming unit to move from the transport position to the mount position.

8. The image forming apparatus according to claim 7, wherein the image forming unit includes an image carrier on which a developer image is to be carried, wherein the apparatus body includes a transfer unit which includes a belt configured to contact the image carrier and transfer the developer image carried on the image carrier to a member, and wherein when the image forming unit is arranged at the transport position, the image carrier is spaced from the belt, and when the image forming unit is arranged at the mount position, the image carrier contacts the belt.

9. The image forming apparatus according to claim 7, wherein the apparatus body includes a positioning part for positioning the image forming unit at the mount position, wherein the image forming unit includes a contact part configured to contact the positioning part, and wherein when the image forming unit is arranged at the transport position, the contact part is arranged to oppose the positioning part at an interval.

10. The image forming apparatus according to claim 1, further comprising:

an operation part for performing an operation of moving the restraint member in a direction from the restraint release position toward the restraint position.

11. The image forming apparatus according to claim 1, wherein the moving member applies a force to the restraint member to be held at the restraint position.

* * * * *